US010036580B2

(12) United States Patent
Zha et al.

(10) Patent No.: US 10,036,580 B2
(45) Date of Patent: Jul. 31, 2018

(54) MULTI-STAGE SYSTEM FOR COOLING A REFRIGERANT

(71) Applicant: LENNOX INDUSTRIES INC., Richardson, TX (US)

(72) Inventors: Shitong Zha, Snellville, GA (US); Robert B. "Dutch" Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 13 days.

(21) Appl. No.: 15/407,418

(22) Filed: Jan. 17, 2017

(65) Prior Publication Data

US 2017/0122624 A1 May 4, 2017

Related U.S. Application Data

(63) Continuation-in-part of application No. 13/663,778, filed on Oct. 30, 2012, now Pat. No. 9,879,888.

(51) Int. Cl.
*F25B 21/02* (2006.01)
*F25B 25/00* (2006.01)
(Continued)

(52) U.S. Cl.
CPC ..... *F25B 21/02* (2013.01); *F25B 25/00* (2013.01); *F25B 40/02* (2013.01); *F25B 49/02* (2013.01); *F25B 2321/021* (2013.01); *F25B 2339/041* (2013.01); *F25B 2400/0417* (2013.01); *F25B 2500/29* (2013.01); *F25B 2600/2501* (2013.01); *F25B 2700/2106* (2013.01)

(58) Field of Classification Search
CPC ..... F25B 21/02; F25B 49/02; F25B 40/02; F25B 25/00; F25B 2700/2106; F25B 2600/2501; F25B 2500/29; F25B 2321/021; F25B 2400/0417; F25B 2339/041
See application file for complete search history.

(56) References Cited

U.S. PATENT DOCUMENTS 3,435,631 A * 4/1969 Wood, Jr. ..... F25B 6/04 62/305
4,435,962 A * 3/1984 Mochizuki ..... F25B 5/00 62/175

(Continued)

*Primary Examiner* — Emmanuel Duke
(74) *Attorney, Agent, or Firm* — Baker Botts L.L.P.

(57) ABSTRACT

According to certain embodiments, a refrigeration system comprises first and second evaporators, first and second compressors, and a gas cooler. The first and second evaporators receive liquid refrigerant from a flash tank and evaporate the refrigerant to cool a first case and a second case, respectively. The second case has a higher temperature set point than the first case. The first compressor compresses the refrigerant discharged from the first evaporator. The second compressor compresses the refrigerant discharged from the first compressor, flash gas from the flash tank, and the refrigerant discharged from the second evaporator. The gas cooler comprises an air-cooled stage that cools the refrigerant discharged from the second compressor and an evaporative stage that cools the refrigerant discharged from the air-cooled stage. The gas cooler further comprises an outlet that supplies the cooled refrigerant to the flash tank through an expansion valve.

20 Claims, 11 Drawing Sheets

(51) Int. Cl.
*F25B 40/02* (2006.01)
*F25B 49/02* (2006.01)

(56) References Cited

U.S. PATENT DOCUMENTS

| | | | | | |
|---|---|---|---|---|---|
| 5,444,971 | A * | 8/1995 | Holenberger | F02C 7/04 | 60/728 |
| 7,219,505 | B2 * | 5/2007 | Weber | F24F 3/153 | 62/156 |
| 2011/0023514 | A1 * | 2/2011 | Mitra | F25B 1/10 | 62/222 |
| 2011/0138825 | A1 * | 6/2011 | Chen | F25B 49/02 | 62/115 |
| 2012/0011866 | A1 * | 1/2012 | Scarcella | F25B 1/10 | 62/79 |
| 2012/0227427 | A1 * | 9/2012 | Liu | F25B 1/10 | 62/115 |
| 2012/0285185 | A1 * | 11/2012 | Huff | F25B 1/10 | 62/115 |
| 2013/0319036 | A1 * | 12/2013 | Taras | F25B 1/10 | 62/434 |

* cited by examiner

MULTI-STAGE SYSTEM FOR COOLING A REFRIGERANT

RELATED APPLICATIONS

This application is a Continuation-in-Part and claims the benefit of priority under 35 U.S.C. § 120 of U.S. patent application Ser. No. 13/663,778, filed Oct. 30, 2012, and entitled "Auxiliary Heat Exchangers."

TECHNICAL FIELD

Certain embodiments of the present disclosure relate, in general, to a multi-stage system for cooling a refrigerant.

BACKGROUND

Air conditioners provide cool air by evaporating cool liquid refrigerant. Cool refrigerant is provided to evaporators by condensers, during operation. The temperature of the cool liquid refrigerant provided by the condenser is dependent on the ambient temperature. The condensers condense hot gaseous refrigerant delivered from a compressor to a cooler liquid refrigerant. A condenser fan may blow air on the hot gaseous refrigerant to remove heat from the gaseous refrigerant.

Refrigeration systems are similar to air conditioners in the sense that both systems supply cool refrigerant to an evaporator in order to cool a space. As examples, the space being cooled may be a home or other building in the case of an air conditioner, or a refrigerated case or freezer in the case of a refrigeration system. Refrigerant discharged from the evaporator is compressed and cooled so that the refrigerant can again be circulated to the evaporator for continued cooling.

SUMMARY

In certain implementations, a refrigeration system comprises first and second evaporators, first and second compressors, and a gas cooler. The first and second evaporators receive liquid refrigerant from a flash tank and evaporate the refrigerant to cool a first case and a second case, respectively. The second case has a higher temperature set point than the first case. The first compressor compresses the refrigerant discharged from the first evaporator. The second compressor compresses the refrigerant discharged from the first compressor, the flash gas from the flash tank, and the refrigerant discharged from the second evaporator. The gas cooler comprises an air-cooled stage that cools the refrigerant discharged from the second compressor and an evaporative stage that cools the refrigerant discharged from the air-cooled stage. The gas cooler further comprises an outlet that supplies the cooled refrigerant to the flash tank through an expansion valve.

In various implementations, a system may include an auxiliary heat exchanger. The auxiliary heat exchanger may include a first surface and an opposing second surface. Fluid retention member(s) may be coupled to at least a portion of the first surface and/or a refrigerant conduit may be coupled to at least a portion of the second surface. A temperature of at least a part of the refrigerant in the refrigerant conduit may be reduced by heat transfer from the refrigerant to at least one of the fluid retention members.

Implementations may include one or more of the following features. The auxiliary heat exchanger may include a condensate line coupled to at least one of the fluid retention members. The auxiliary heat exchanger may include a container coupled to at least one of an evaporator or a water line. A fluid leaving the container may flow to at least one of the fluid retention members. The container may automatically allow water to flow from the water line into the container when a fluid level in the container is less than a predetermined fluid level. The system may include an air conditioner that includes a switch. The switch may control the operation of the auxiliary heat exchanger. The auxiliary heat exchanger reduces a temperature of at least a portion of the refrigerant leaving a condenser of the air conditioner. At least one of the fluid retention members may include channels. The channels may retain fluid at least partially in the channels. Air may flow proximate the channels and at least partially evaporate the fluid at least partially retained in the channels to reduce a temperature of at least a part of the refrigerant.

In various implementations, a system may include an auxiliary heat exchanger. The auxiliary heat exchanger may include a first surface and a second opposing surface. The auxiliary heat exchanger may include thermoelectric cooler(s) coupled to at least a portion of the first surface of the auxiliary heat exchanger and/or a refrigerant conduit coupled to at least a portion of the second surface of the auxiliary heat exchanger. A temperature of at least a part of the refrigerant in the refrigerant conduit may be reduced by heat transfer to at least one of the thermoelectric coolers.

Implementations may include one or more of the following features. A temperature of a refrigerant leaving the auxiliary heat exchanger may be less than approximately 3° F. above an ambient temperature. The auxiliary heat exchanger may include an air inlet and an air outlet. At least a portion of the air from the condenser blower may flow through the air inlet to the air outlet. A portion of the air may remove heat from at least one of the thermoelectric coolers. The system may include an air conditioner and the air conditioner may include the auxiliary heat exchanger. The auxiliary heat exchanger may reduce a temperature of at least a portion of the refrigerant leaving the condenser of the air conditioner. The auxiliary heat exchanger may be at least partially coupled to the condenser of the air conditioner. The auxiliary heat exchanger may include a converter to convert alternating current to direct current. The converter may provide direct current to at least one of the thermoelectric coolers. The system may be a retrofit kit to couple to an air conditioner.

Various implementations may include providing refrigerant to a condenser of an air conditioner and condensing the refrigerant to a liquid at a first temperature using the condenser. A determination may be made whether a request to operate the auxiliary heater has been received. If the request for operation of the auxiliary heat exchanger has been received: the liquid refrigerant may be provided at the first temperature to the auxiliary heat exchanger; the auxiliary heat exchanger may be allowed to reduce the temperature of the refrigerant in the auxiliary heat exchanger to a second temperature; and at least a portion of the refrigerant may be provided at the second temperature to the evaporator.

Implementations may include one or more of the following features. Allowing the auxiliary heat exchanger to reduce the temperature of the refrigerant in the auxiliary heat exchanger to a second temperature may include: allowing a fluid to flow to one or more fluid retention members at least partially coupled to a first surface of the auxiliary heat exchanger; allowing the refrigerant to flow through a refrigerant conduit at least partially coupled to a second surface of the auxiliary heat exchanger; and/or allowing heat to transfer between the refrigerant in the refrigerant conduit and at least one of the fluid retention members. A temperature of the refrigerant may be reduced to the second temperature by the heat transfer from the refrigerant to at least one of the fluid retention members. The second surface may be opposed to the first surface of the auxiliary heat exchanger. Condensate from the evaporator of the air conditioner may be allowed to flow into a container. A determination may be made whether to allow water from a water line to flow into the container. The water may be allowed to flow into the container if the determination is made to allow water from the water line to flow into the container. A fluid may be allowed to flow from the container to at least one of the fluid retention members.

Allowing the auxiliary heat exchanger to reduce the temperature of the refrigerant in the auxiliary heat exchanger to a second temperature may include: allowing one or more thermoelectric coolers at least partially coupled to a first surface of the auxiliary heat exchanger to operate; allowing the refrigerant to flow through a refrigerant conduit at least partially coupled to a second surface of the auxiliary heat exchanger; and allowing heat to transfer between the refrigerant and at least one of the thermoelectric coolers. A temperature of at least a part of the refrigerant in the refrigerant conduit may be reduced to a second temperature by the heat transfer from the refrigerant to at least one of the thermoelectric coolers. At least a portion of the liquid refrigerant at the first temperature may be provided to an evaporator of the air conditioner, if the request to operate the auxiliary heater has not been received. When the request to operate the auxiliary heater has been received, a temperature of the refrigerant may be reduced to a second temperature that may be less than approximately 3° F. above an ambient temperature. The air conditioner may include a default setting to request operation of the auxiliary heat exchanger.

The details of one or more implementations are set forth in the accompanying drawings and the description below. Certain embodiments may have one or more technical advantages. As an example, certain embodiments may provide a two-stage gas cooler comprising an air-cooled stage and an evaporative stage. The two-stage gas cooler may provide water savings compared to a gas cooler that uses only evaporative type cooling. The two-stage gas cooler may consume less energy compared to a gas cooler that uses only air-cooled type cooling. The two-stage gas cooler may be particularly well-suited to hot and dry climates that would otherwise require a lot of energy and/or water to cool refrigerant. Certain embodiments may have all, some, or none of these advantages. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

In various implementations, the temperature of refrigerant in an air conditioner may be reduced using an auxiliary heat exchanger. For example, an auxiliary heat exchanger may reduce the temperature of refrigerant exiting a condenser of the air conditioner using fluid retention member(s), thermoelectric cooler(s), and/or other appropriate heat exchanger(s).

Figure 1:
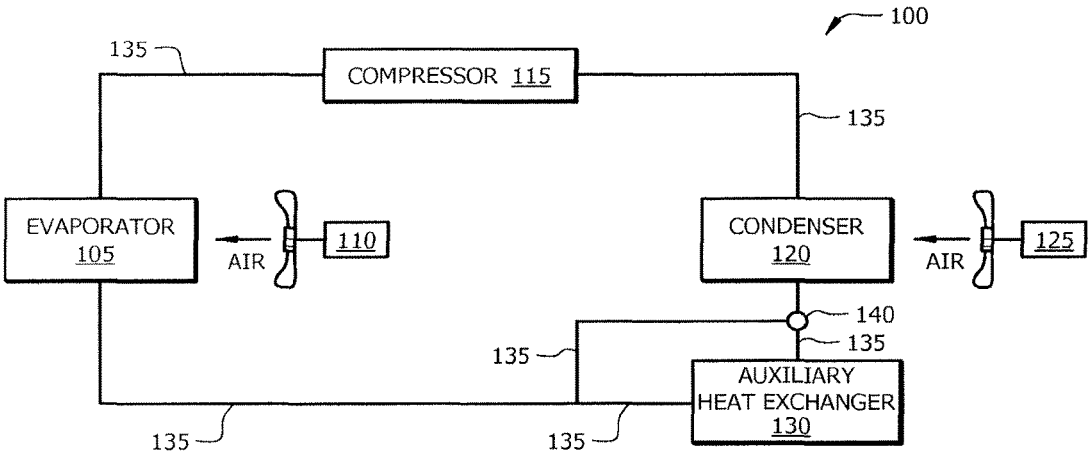
FIG. 1 illustrates an implementation of an example of an air conditioner.

FIG. 1 illustrates an implementation of an example air conditioner 100. The air conditioner 100 may include components such as an evaporator 105, evaporator fan 110, compressor 115, condenser 120, condenser fan 125, and auxiliary heat exchanger 130. The air conditioner 100 may include a thermal expansion valve (not shown) and/or control system (not shown) to manage operations of the air conditioner. One or more of the components may be coupled through refrigerant lines 135 (e.g., conduit between components at least partially containing refrigerant during use). During use, the evaporator 105 allows liquid refrigerant (e.g., R-22 and/or R-410A) to evaporate to form a gaseous refrigerant that is provided to the compressor 115. At least a portion of the air from the evaporator fan 110 may flow at least partially through the evaporator 105 and the cooler air exiting the evaporator may be provided (e.g., via ducting) to a location.

The compressor 115 may increase the pressure of the gaseous refrigerant and the higher pressure gas is provided to the condenser 120. The condenser 120 allows at least a portion of the gaseous refrigerant to condense into a liquid. At least a portion of the air from the condenser fan 125 may flow at least partially through the condenser 120 and absorb heat from the refrigerant, which may allow at least portions of the gaseous refrigerant to liquefy.

At least a portion of the liquid refrigerant from the condenser 120 may be allowed to flow to the auxiliary heat exchanger 130. For example, the air conditioner 100 may include a switch 140 that allows fluid flow (e.g., at least a part of the refrigerant from the condenser and/or at least a part of the air from the condenser fan) to be directed to and/or bypass the auxiliary heat exchanger 130. A controller (e.g., a computer) may determine whether to allow fluid flow to the auxiliary heat exchanger 130. For example, a controller may respond to a user request for operation of the auxiliary heat exchanger 130. In some implementation, a controller may determine whether to operate the auxiliary heat exchanger 130 based on a request from a user (e.g., when cooling is requested by a user during high ambient temperatures, such as above 85° F.). An air conditioner may include a default setting, such as to allow operation of the auxiliary heat exchanger 130 and/or to restrict operation of the air conditioner without use of the auxiliary heat exchanger. In some implementations, at least a part of the refrigerant may bypass the auxiliary heat exchanger and flow to the evaporator. In some implementations, the air conditioner 100 may include a metering device (not shown), such as a thermal expansion valve. The liquid refrigerant may be allowed to at least partially pass from the auxiliary heat exchanger 130 and/or condenser 120 through the thermal expansion valve. The thermal expansion valve may allow and/or restrict fluid flow through the valve at least partially based on the automatic adjustment of the thermal expansion valve and/or the control system.

The auxiliary heat exchanger 130 may reduce the temperature of at least a part of the refrigerant from the condenser 120. When the refrigerant leaves the auxiliary heat exchanger 130, the refrigerant may be at an exit temperature less than a predetermined temperature. For example, the exit temperature of the refrigerant may be: less than approximately one degree Fahrenheit above ambient temperature (e.g., Ambient temperature+approximately 1° F.); and/or less than approximately three degrees Fahrenheit above ambient temperature (e.g., Ambient temperature+ approximately 3° F.). The exit temperature of the refrigerant may be less than or approximately equal to ambient temperature.

Ambient temperature may be a temperature proximate at least a portion of the auxiliary heat exchanger 130, the condenser 120, and/or the condenser fan 125 (e.g., ambient temperature may be a temperature proximate an opening of an auxiliary heat exchanger). A sensor may be positioned proximate the condenser 120 and a controller may be coupled to the sensor to determine the ambient temperature.

By reducing the temperature of the refrigerant entering the evaporator 105, the capacity of the evaporator may be increased. When the capacity of the evaporator 105 is increased, the EER (energy efficiency ratio) may be increased. For example, since the temperature of the refrigerant is cooler (e.g., than in a system without an auxiliary heat exchanger), more heat may be transferred from air proximate the evaporator 105 and thus, more cool air can be provided to a location in response to a user request. The boost in capacity of the evaporator 105 may allow an air conditioner to operate more effectively (e.g., more responsive to a user request, be able to provide cooler air, and/or operation may be less likely to cause mechanical failure). An air conditioner with an auxiliary heat exchanger may have a higher EER rating than a similar air conditioner without an auxiliary heat exchanger (e.g., an air conditioner with at least some similarly sized components) because the cooling capacity of the air conditioner may be increased with little and/or no increase in energy use, in some implementations.

In some implementations, auxiliary heat exchanger 130 may be similar to the condenser 120. For example, the auxiliary heat exchanger 130 may be a heat exchanger similar to and smaller in scale (e.g., in output capabilities) than the condenser 120. For example, the auxiliary heat exchanger 130 may include a second refrigerant that cools the refrigerant from the condenser 120. The second refrigerant may be the same and/or different from the refrigerant from the condenser 120. Mixing between the refrigerant from the condenser 120 and the second refrigerant may be inhibited. A second compressor of the auxiliary heat exchanger 130 may compress the second refrigerant. The compressor of the auxiliary heat exchanger 130 may be separate from the compressor 120 of the air conditioner. The compressed second refrigerant may be allowed to flow to a second condenser (e.g., a second condenser unit and/or a portion of the condenser of the air conditioner) to cool the first refrigerant (e.g., the refrigerant flowing from the condenser 120 to the evaporator 105 of the air conditioner 100).

Figure 2A:
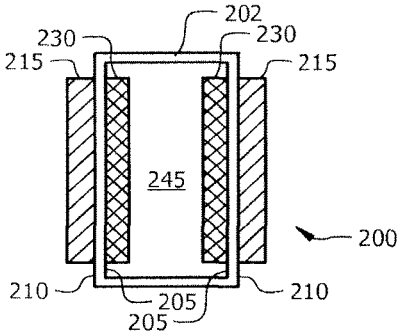
FIG. 2A illustrates a cross-sectional view of an implementation of an example auxiliary heat exchanger.
Figure 2B:
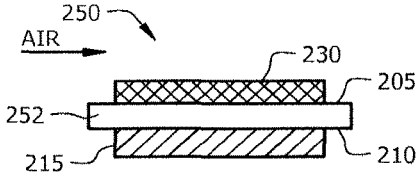
FIG. 2B illustrates a cross-sectional view of an implementation of an example auxiliary heat exchanger.
Figure 3:
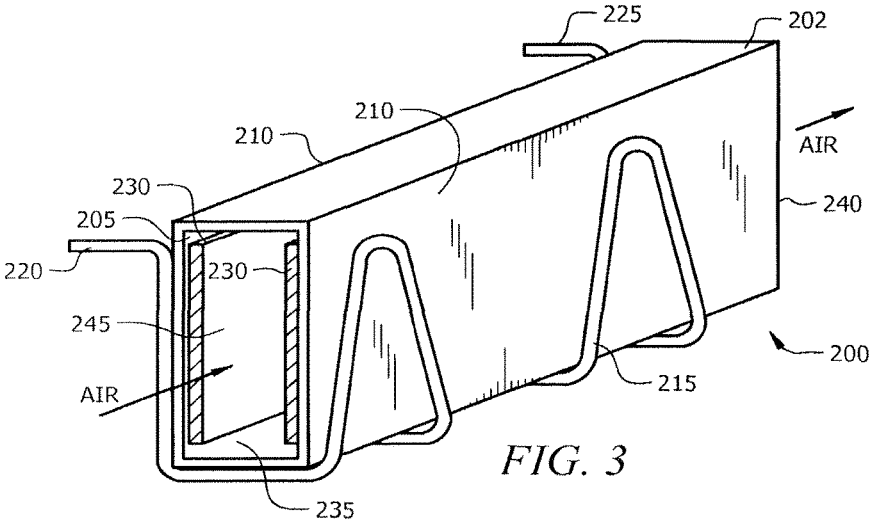
FIG. 3 illustrates a perspective view of an implementation of an example auxiliary heat exchanger.

In some implementations, the auxiliary heat exchanger 130 may include components, such as fluid retention member(s) and/or thermoelectric cooler(s). FIG. 2A illustrates a cross-sectional view of an implementation of an example of an auxiliary heat exchanger 200. FIG. 2B illustrates a cross-sectional view of an implementation of an example auxiliary heat exchanger 250. FIG. 3 illustrates a perspective view of an implementation of an example of an auxiliary heal exchanger 200.

The auxiliary heat exchanger may include a housing. The housing may include thermally conductive material. The auxiliary heat exchanger and/or housing may have a cross-sectional shape similar to a circle, oval, line, c-shaped, and/or any other appropriate shape. For example, as illustrated in FIGS. 2A and 3, a housing 202 of the auxiliary heat exchanger 200 may have a rectangular cross-sectional shape. The auxiliary heat exchanger may be tubular. As illustrated in FIG. 2B, a housing 252 of the auxiliary heat exchanger 250 may be a plate (e.g., with planar and/or curved sections). In some implementations, the auxiliary heat exchanger may include two plates (e.g., with planar and/or curved sections) and an opening disposed between the plates. In sonic implementations, a shape of an auxiliary heat exchanger may be selected to control air flow. For example, as illustrated in FIGS. 2A and 3, the rectangular cross-sectional shape of the housing 202 may restrict airflow to the opening 245 disposed in the housing.

As illustrated in FIGS. 2A, 2B, and 3, the auxiliary heat exchanger 200, 250 may include two opposing surfaces, a first surface 205 and a second surface 210. For example, as illustrated in FIGS. 2A and 3, the first surface 205 may be at least a portion of an inner surface of the auxiliary heat exchanger 200 and/or the second surface 210 may be at least a portion of the outer surface of the auxiliary heat exchanger. As illustrated in FIG. 2B, the first surface 205 and the second surface 210 may be opposing sides of a plate (e.g., a plate with curved and/or planar portions) of the auxiliary heat exchanger 250.

The auxiliary heat exchanger 200, 250 may include a refrigerant line 215 disposed proximate the second surface 210. The refrigerant line 215 may be coupled to at least a portion of the second surface 210. For example, the refrigerant line 215 may be coupled to at least a portion of the second surface 210 using clips, soldering, brazing, and/or welding. The refrigerant line 215 may include a refrigerant inlet 220 and a refrigerant outlet 225.

The auxiliary heat exchanger 200, 250 may include fluid retention member(s) 230 disposed proximate the first surface 205. The fluid retention member(s) 230 may be coupled to at least a portion of the first surface 205. The fluid retention member 230 may be glued to a portion of the first surface 205, for example. In some implementations, the fluid retention member 230 may be a portion of and/or integrated with the first surface 205 of the auxiliary heat exchanger 200, 250.

As illustrated in FIGS. 2A and 3, the auxiliary heat exchanger 200 may include an air inlet 235 and an air outlet 240. Air may flow at least partially through an opening 245 disposed between the opposing first surfaces 205. The air flow may be generated by the condenser fan. For example, a portion of the air flow generated by the condenser fan may be directed to the auxiliary heat exchanger 200. The air flow may enter the auxiliary heat exchanger 200 at and/or proximate to the air inlet 235 and leave the auxiliary heat exchanger at and/or proximate to the air outlet 240.

As illustrated in FIGS. 2A and 3 the air flow (e.g., from a condenser fan) through the opening 245 of the auxiliary heat exchanger 200 may remove heat (e.g., from the first surface 205 and/or a fluid retention member 230) As illustrated in FIG. 2B, air (e.g., from a condenser fan) may flow proximate a surface of the fluid retention member 230. A fluid, such as water from condensate and/or a water line, may be disposed and/or retained at least partially on the fluid retention member 230. The water may have a lower temperature than the refrigerant in the refrigerant line 215. Heat from the refrigerant may be transferred to the refrigerant conduit 215. The heat from the refrigerant conduit 215 may be transferred through a housing 202, 252 of the auxiliary heat exchanger 200, 250 to fluid retention member(s) 230. The heat from a fluid retention member 230 may be transferred to the fluid at least partially retained by the fluid retention member. As the air flow proximate the fluid retention member 230, at least a portion of the fluid in the fluid retention member may evaporate. The fluid may evaporate due to the heat transfer from refrigerant, refrigerant conduit 215, housing 202, 252, fluid retention member 230, and/or air flow. Approximately 1000 BTUs of energy may be absorbed by evaporation of each pound of the fluid (e.g., water) and so, heat may be removed from the refrigerant and the temperature of the refrigerant may be reduced.

In some implementations, as illustrated in FIGS. 2A, 2B, and 3, the first surface 205 may be cooled (e.g., a temperature may be reduced) by the evaporation of the fluid at least partially retained by the fluid retention member(s) 230. The cooling of the first surface 205 may cool the second surface 210, the housing 202, 252, the refrigerant conduit 215, and/or the refrigerant. Thus, the evaporation of fluid from the fluid retention members 230 may cool and/or reduce the temperature of the refrigerant.

In some implementations, the fluid retention members 230 may at least partially absorb fluid and/or at least partially retain fluid. The fluid retention member 230 may retain fluid for a period of time and then allow fluid to flow from the fluid retention member. For example, the fluid retention member 230 may retain a fluid and allow the fluid to evaporate from the fluid retention member.

Figure 4:
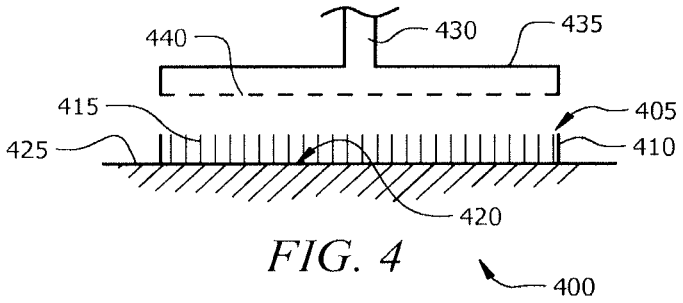
FIG. 4 illustrates a cross-sectional view of an implementation of a portion of an example auxiliary heat exchanger.

The fluid retention members 230 may include an absorbent pad (e.g., a cloth), a coated member, a plate with bristles, fins, channels, tubing, and/or a flocked plate. For example, a flocked plate may include a plate with fibers coupled in a normal direction to the plate. FIG. 4 illustrates an implementation of a portion 400 of an auxiliary heat exchanger. As illustrated, the fluid retention member 405 includes flocking 410. The flocking 410 may include fibers 415. The fibers 415 may be coupled to the plate 420 such that the fibers are normal to the plate. The fibers 415 may retain fluid in and/or within the fluid retention member 405. The flocking 410 may include polyester fibers coupled to a surface of the fluid retention member 405, as an example. In some implementations, the fluid retention member 405 may include channels (e.g., disposed between fibers 415 and/or formed in the fluid retention members) and/or recesses to at least partially retain (e.g., temporarily retain and/or retain a portion of) the fluid).

The fluid retention member 405 may be coupled to a portion of the first surface 425 of the auxiliary heat exchanger. In some implementations, the fluid retention member 405 may be a portion of and/or formed in the first surface 425 of the auxiliary heat exchanger. The fluid retention member 405 may be glued to a first surface 425 of the auxiliary heat exchanger 405, for example. In some implementations, the fibers 415 may be glued directly to the first surface 425 of the auxiliary heat exchanger.

The auxiliary heat exchanger may include a conduit 430 coupled to a distributer 435 to deliver a fluid to the fluid retention member 405. The distributer 435 may include a plurality of openings 440. During use, a fluid, such as water (e.g., from condensate and/or water from a water line), may be delivered to the auxiliary heat exchanger via the conduit 430. The distributer 435 may deliver fluid from the conduit 430 to the fluid retention member 405. The openings 440 may provide the fluid across a surface of the fluid retention member 405. For example, the fluid may flow from the openings 440 and be at least partially retained by the fibers 415 and/or channels of the fluid retention member 405.

Various implementations of auxiliary heat exchangers have been described as including a housing to which fluid retention members and/or refrigerant conduit are coupled, as examples. In some implementations, the fluid retention member may be directly coupled to a refrigerant conduit such that a first surface and a second surface are surfaces of the refrigerant conduit. In some implementations, the refrigerant conduit may be coupled to a portion of the fluid retention member (e.g., a plate of the fluid retention member). In some implementations, the fluid retention member may include flocked vertical fins proximate a refrigerant conduit.

Figure 5:
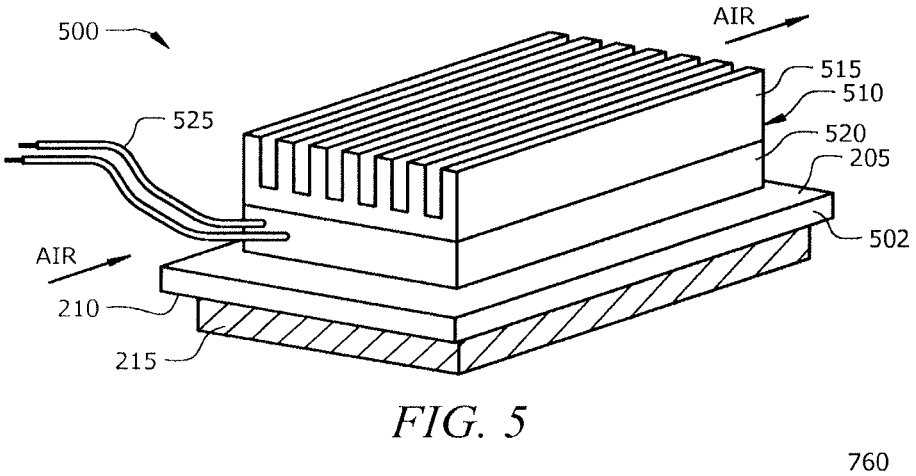
FIG. 5 illustrates a perspective view of an implementation of an example auxiliary heat exchanger.

In some implementations, the auxiliary heat exchanger may include thermoelectric cooler(s). FIG. 5 illustrates an implementation of an example auxiliary heat exchanger 500 comprising a thermoelectric cooler 510. The auxiliary heat exchanger 500 may include a housing 502, such as a plate. The thermoelectric cooler 510 may be disposed in an auxiliary heat exchanger similarly to a fluid retention member. The thermoelectric cooler 510 may be coupled to at least a portion of the first surface 205 of the housing 502 of the auxiliary heat exchanger 500 and the refrigerant line 215 may be coupled at least partially to the second surface 210 of the housing 502. In some implementations, the thermoelectric cooler 510 may include a portion configured to couple to a portion of the condenser (e.g., a portion of the condenser may function as the auxiliary heat exchanger and reduce the temperature of the refrigerant lower than the condenser could without the auxiliary heat exchanger). For example, a heat resistant coupling may be included on a surface of the thermoelectric cooler 510 to affix the thermoelectric cooler to a part of the condenser.

The thermoelectric cooler may include any appropriate thermoelectric cooler, such as a thermoelectric cooler commercially available from Marlow Industries (Dallas, Tex.) and/or devices that utilize Peltier effects. The thermoelectric cooler may be coupled to a battery or other power source (e.g., through wires 525 coupled to the thermoelectric cooler). In some implementations, a converter (e.g., AC to DC) may be coupled to the thermoelectric cooler so that the thermoelectric cooler may operate using the same power source as the air conditioner.

The thermoelectric cooler 510 may include opposing hot 515 and cold 520 sides. For example, during use the thermoelectric cooler 510 may generate a cold side 520 and a hot side 515. The temperature of the cold side 520 may be less than a temperature of the hot side 515. The cold side 520 of the thermoelectric cooler may be coupled to the first surface 205 of the housing 502 of the auxiliary heat exchanger 500 and the refrigerant line 215 may be coupled to the second surface 210 of the housing 502 of the auxiliary heat exchanger 500. During use, heat may transfer from the refrigerant in the refrigerant line 215, to the housing 502, and/or to the cold side 520 of the thermoelectric cooler 510. Air from a condenser fan may direct air towards the hot side 515 of the thermoelectric cooler and/or remove heat from the hot side. Thus, the temperature of the refrigerant may be reduced by the thermoelectric cooler, in some implementations.

Figure 6:
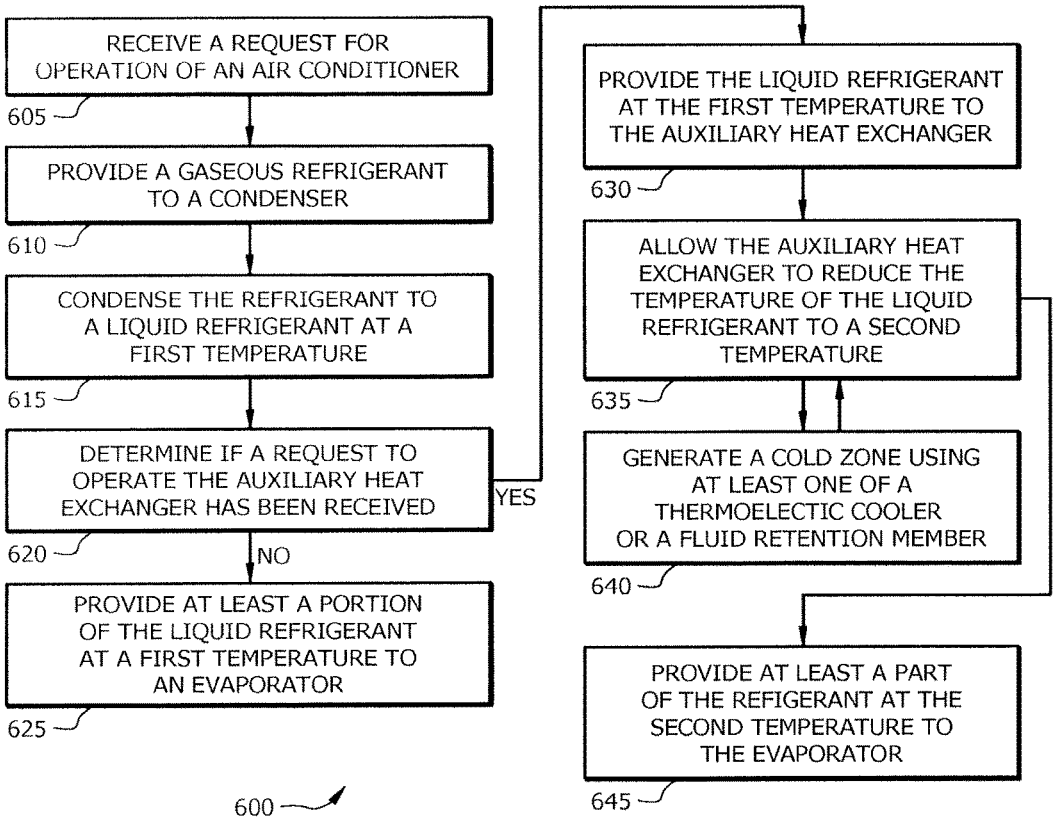
FIG. 6 illustrates an implementation of an example process for operation of an air conditioner.

FIG. 6 illustrates an implementation of an example process 600 for operation of an air conditioner. A request for operation of an air conditioner may be received (operation 605). For example, a user may request that cold air be delivered to a location.

A gaseous refrigerant may be provided to a condenser (operation 610). During operation of the air conditioner, refrigerant may provide cool air to a location using the evaporator and ducting to a location (e.g., cool air provided by the evaporator and evaporator blower may be transported to the location using the ducting). The refrigerant may leave the evaporator as a gas, be at least partially compressed, and provided to the condenser.

The refrigerant may be at least partially condensed to a liquid refrigerant at a first temperature (operation 615). For example, the condenser may condense the gaseous refrigerant that has been compressed. The liquid refrigerant leaving the condenser may be at a first temperature. Since the heat exchange in the condenser is between the air at ambient temperature and the refrigerant, the temperature to which the refrigerant can be lowered may be restricted by the temperature of the air. The first temperature may be, for example, at least ten degrees Fahrenheit greater than ambient temperature (e.g., 10° F.+Ambient temperature).

Whether a request to operate the auxiliary heat exchanger has been received may be determined (operation 620). For example, the controller of an air conditioner may monitor ambient temperatures and automatically allow the auxiliary heat exchanger to operate during a predetermined temperature range (e.g., temperatures greater than 82° F., temperatures greater than 116° F.). As another example, a default setting of an air conditioner may include a request that an auxiliary heat exchanger operation be allowed and/or restricted. In some implementations, a user may request operation of the auxiliary heat exchanger.

At least a part of the refrigerant at the first temperature may be provided to the evaporator of the air conditioner, if a determination has been made that a request to operate the auxiliary heal exchanger has not been received (operation 625). For example, the auxiliary heat exchanger may he bypassed and the refrigerant may flow from the condenser to an expansion valve and/or evaporator. In some implementations, the auxiliary heat exchanger may be turned off or remain off when the request to operate the auxiliary heat exchanger has not been received. For example, the air flow to the auxiliary heat exchanger may be turned off, and/or water flow from the condensate and/or other source may be restricted. Thus, even though the refrigerant at the first temperature flows through the auxiliary heat exchanger, the auxiliary heat exchanger does not substantially lower the temperature of the refrigerant.

In some implementations, operation of an auxiliary heat exchanger may be not requested and/or the auxiliary heat exchanger may be bypassed. For example, to increase the length of a cooling cycle, the operation of the auxiliary heat exchanger may be restricted. For example, when the auxiliary heat exchanger is used in conjunction with the condenser on cold days (e.g., 65 degrees Fahrenheit), the air conditioner may quickly reach a temperature requested by the user and quickly cycle on and off. The quick cycle (e.g., short and repetitive cycles) may stress the air conditioner and/or may lead to premature mechanical failure of the air conditioner. Thus, an auxiliary heat exchanger may be bypassed and the air conditioner may operate for longer cycles (e.g., compared to operations using the auxiliary heat exchanger) using the condenser and restricting use of the auxiliary heat exchanger (e.g., bypass the auxiliary heat exchanger).

At least a part of the liquid refrigerant at the first temperature may be provided to the auxiliary heat exchanger, if a determination has been made that a request to operate the auxiliary heat exchanger was received (operation 630). For example, a user may request operation of the auxiliary heat exchanger. When temperatures are high (e.g., greater than 82° F.), the auxiliary heat exchanger may allow the evaporator to have a greater capacity (e.g., because a temperature of the refrigerant provided to the evaporator is lower than the temperature of the refrigerant exiting the condenser) when compared to a similar air conditioner without an auxiliary heat exchanger (e.g., an air conditioner with one or more similarly sized components, such as a condenser).

The auxiliary heat exchanger may be allowed to reduce the temperature of the liquid refrigerant to a second temperature (operation 635). Since heat is transferred between a cold zone in the auxiliary heat exchanger and the refrigerant, a lower temperature may be obtained in the refrigerant (e.g., when compared with the refrigerant temperature exiting the condenser and/or when use of the auxiliary heat exchanger is restricted). For example, the auxiliary heat exchanger may be allowed to reduce the temperature of the liquid refrigerant to a temperature approximately equal to and/or less than ambient temperature (e.g., a temperature proximate at least a portion of the condenser). The temperature of the refrigerant leaving the auxiliary heat exchanger may be less than or approximately equal to 3° F. more than ambient temperature. In some implementations, the auxiliary heat exchanger may reduce the temperature of the refrigerant by a predetermined amount (e.g., reduce the temperature approximately 3° F., 5° F., and/or 10° F.). The auxiliary heat exchanger may reduce the temperature of the refrigerant to approximately equal to ambient temperature or less than ambient temperature, in some implementations.

A cold zone may be generated proximate a surface of an auxiliary heat exchanger using a thermoelectric cooler and/or a fluid retention member (operation 640). For example, a thermoelectric cooler and/or fluid retention member may be coupled to a surface of the auxiliary heat exchanger. The thermoelectric cooler and/or fluid retention member may be allowed to operate such that the surface of the auxiliary heat exchanger proximate the thermoelectric cooler and/or fluid retention member (e.g., first surface) is colder than ambient temperature. Thus, heat from the refrigerant may be transferred to the cold zone and/or removed from the cold zone, in some implementations. When a thermoelectric cooler is used, the air flows across the hot side and may allow the thermoelectric cooler to continue to operate properly (e.g., inhibit overheating). The refrigerant may leave the auxiliary heat exchanger (e.g., via the refrigerant line outlet) at a second temperature. The second temperature may be less than the temperature that at which the refrigerant entered the auxiliary heat exchanger (e.g., via the inlet of the refrigerant line).

At least a part of the liquid refrigerant at the second temperature may be provided to the evaporator of the air conditioner (operation 640). For example, the liquid refrigerant may flow from the auxiliary heat exchanger to the evaporator. In some implementations, a thermal expansion valve may be included to control flow of the refrigerant to the evaporator. The thermal expansion valve may be disposed on a refrigerant line such that refrigerant enters the thermal expansion valve (e.g., from the auxiliary heat exchanger and/or from the condenser, when bypassing the auxiliary heat exchanger) prior to entering the evaporator. Providing cooled refrigerant at a second temperature may increase a capacity of the evaporator (e.g., when compared with the capacity of the evaporator when cooled refrigerant at the first temperature is provided).

Figure 9:
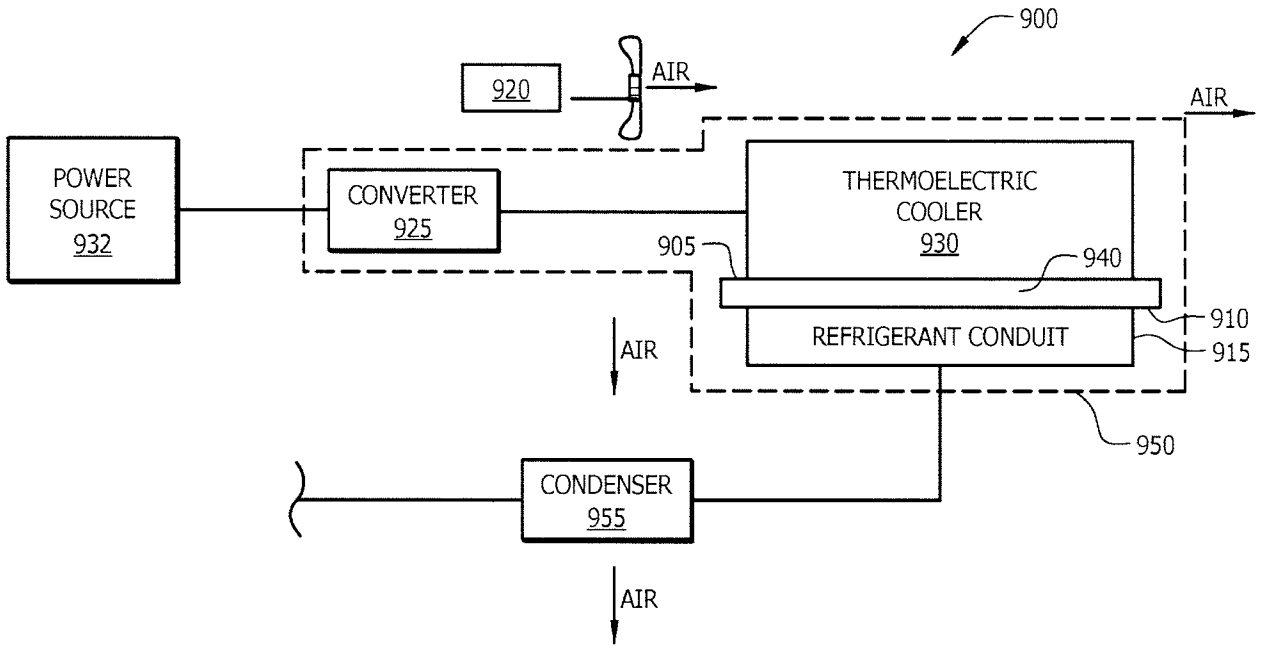
FIG. 9 illustrates an implementation of a portion of an example air conditioner.
Figure 10:
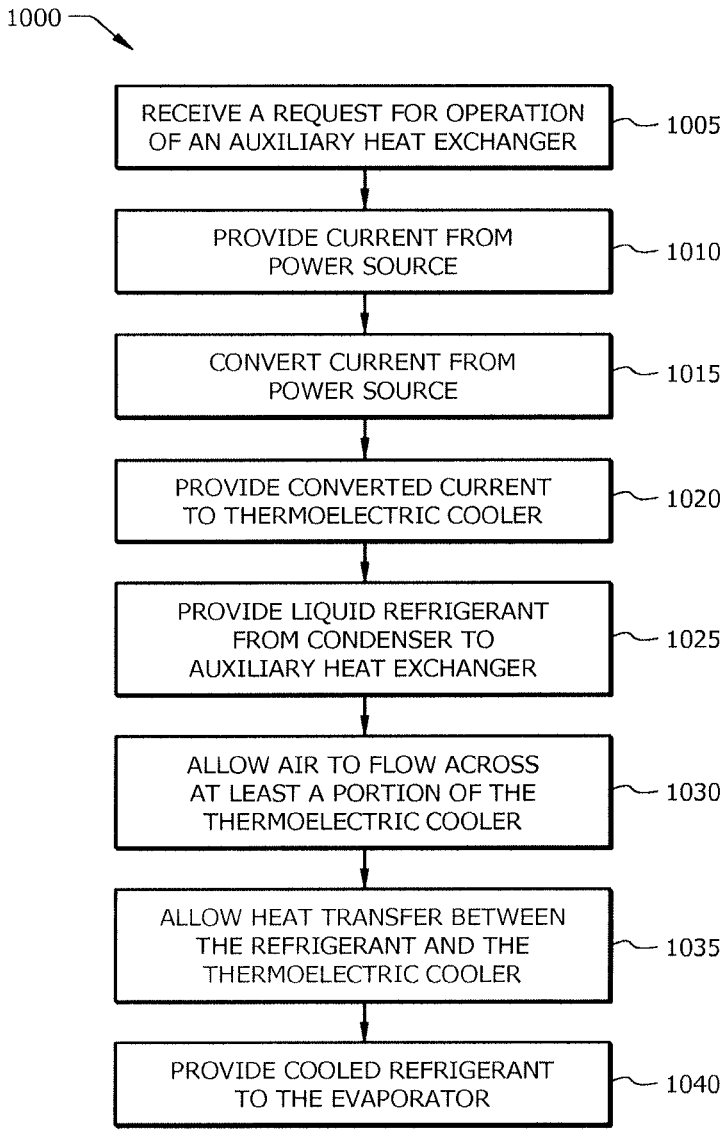
FIG. 10 illustrates an implementation of an example process for operation of an auxiliary heat exchanger.

Process 600 may be implemented by various systems, such as system 100, 200, 250, 400, 500, 700 (illustrated in FIG. 7), and/or 900 (illustrated in FIG. 9). In addition, various operations may be added, deleted, or modified. For example, sensors may be used to determine temperature(s). As another example, an auxiliary heat exchanger may be a second condenser system (e.g., a condenser, a compressor, and/or second refrigerant). A switch may allow the second condenser system to function as an auxiliary heat exchanger and be utilized when requested by the system and/or users (e.g., the second condenser may be turned on and/or off). The second condenser may generate a cold zone that allows heat transfer from the refrigerant from the first condenser (e.g., to a second refrigerant). The temperature of the refrigerant from the first condenser may be lower when exiting the second condenser than when entering the second condenser. For example, the temperature of the refrigerant from the first condenser may he reduced by at least approximately two degrees and/or approximately 3 degrees. In some implementations, the auxiliary heat exchanger may not include a fluid retention member or thermoelectric cooler. The auxiliary heat exchanger may include a second refrigerant, which is evaporated, compressed and/or condensed to provide a cool zone in the auxiliary heat exchanger and cool the refrigerant from the condenser.

Figure 7:
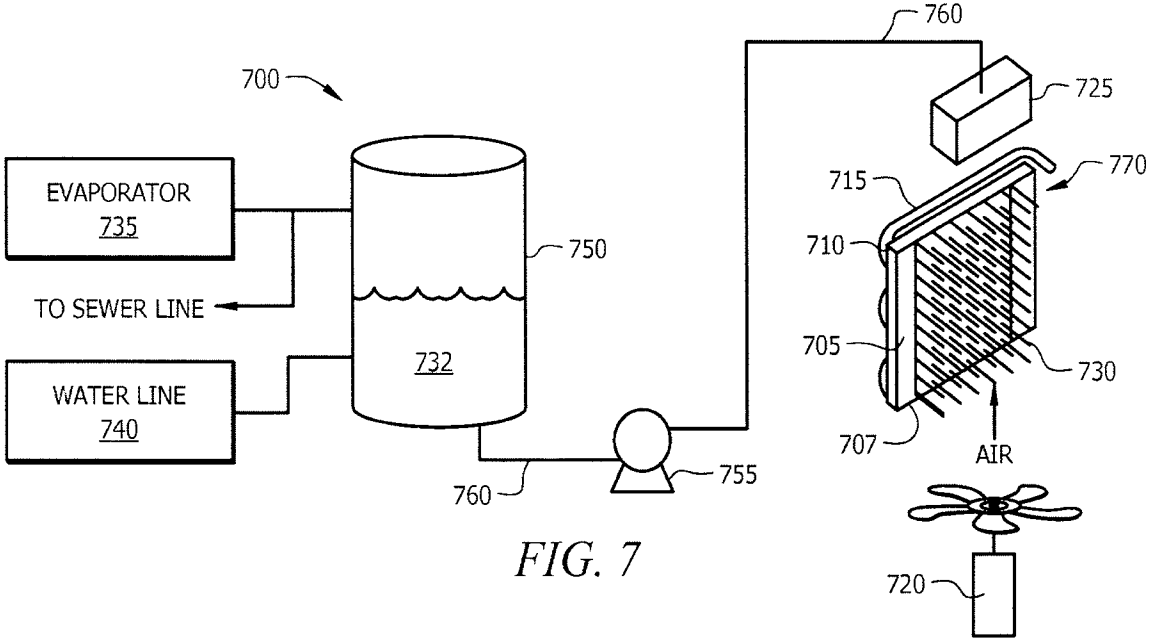
FIG. 7 illustrates an implementation of a portion of an example air conditioner.

In some implementations, a fluid retention member may be utilized to generate a cold zone proximate a surface of the auxiliary heat exchanger. FIG. 7 illustrates an implementation of an example of a portion 700 of an air conditioner system. The auxiliary heat exchanger 770 may include a fluid retention member 730 and a refrigerant line 715 coupled to opposing surfaces (e.g., first surface 705 and second surface 710) of a housing 707 (e.g., a plate) of the auxiliary heat exchanger. At least a portion of an air flow generated by a fan 720 (e.g., condenser blower fan and/or a separate auxiliary heat exchanger fan) may be directed across the fluid retention member 730. The air flow may facilitate heat transfer between the fluid retention member 730 and/or fluids 732 residing at least partially in the fluid retention member and the refrigerant in the refrigerant line 715. For example, the air flow may cool the fluid retention member 730 and/or first surface 705 of the housing 707 by allowing evaporation of at least a part of the fluid at least partially retained by the fluid retention member. The cooling of the first surface 705 may facilitate heat transfer from the refrigerant to the refrigerant conduit, housing, and/or fluid retention member, in some implementations.

Fluids 732 may be delivered to the fluid retention member through distributer 725 coupled to conduit 760. The distributor 725 coupled to the conduit 760 (e.g., fluid line from the container 750) may promote distribution of the condensate approximately evenly across at least a portion of the fluid retention member 730. The fluids 732 may include condensate from the evaporator 735 and/or water from a water line 740 (e.g., a water line may connect to a main water line of the house and/or a municipal water supply). The evaporator condensate outlet may be coupled to a sewer line.

The condensate from the evaporator 735 may be collected in a container 750 (e.g., vessel and/or tank) and/or flow directly through the conduit 760 to the fluid retention member 730.

The container 750 may be coupled to the evaporator 735 and/or the water line 740. The container 750 may restrict and/or allow flow from the evaporator 735 and/or the water line 740. For example, the container 750 may include sensors that open and close valve(s) coupled to line(s) from the evaporator 735 and/or the water line 740. The sensors may determine a fluid level in the container 750 and determine whether to allow fluid to enter the container based on the determined fluid level. In some implementations, float valve(s) may be utilized to restrict and/or allow fluid flow into the container 750 (e.g., a float valve may open the valve to allow water from a water line to enter the container when a predetermined low level is detected by the float valve and/or the float valve may close the valve to restrict water from the water line when a predetermined high level is detected by the float valve).

In some implementations, a pump 755 may be coupled to an exit line (e.g., conduit 760) from the container 750 to deliver fluid to the distributer 755. The evaporator 735 and/or container 750 may be located at a level below the fluid retention member 730 and the pump may deliver fluid from the container as desired. For example, the evaporator and/or container may be located below grade (e.g., in a basement) and the fluid retention member may be located at ground level. The pump may be utilized to deliver fluid to the fluid retention member. In some implementations, the evaporator 735 may be located in an attic, for example, and gravity may allow the fluid to flow from the container to the fluid retention member proximate ground level.

Figure 8:
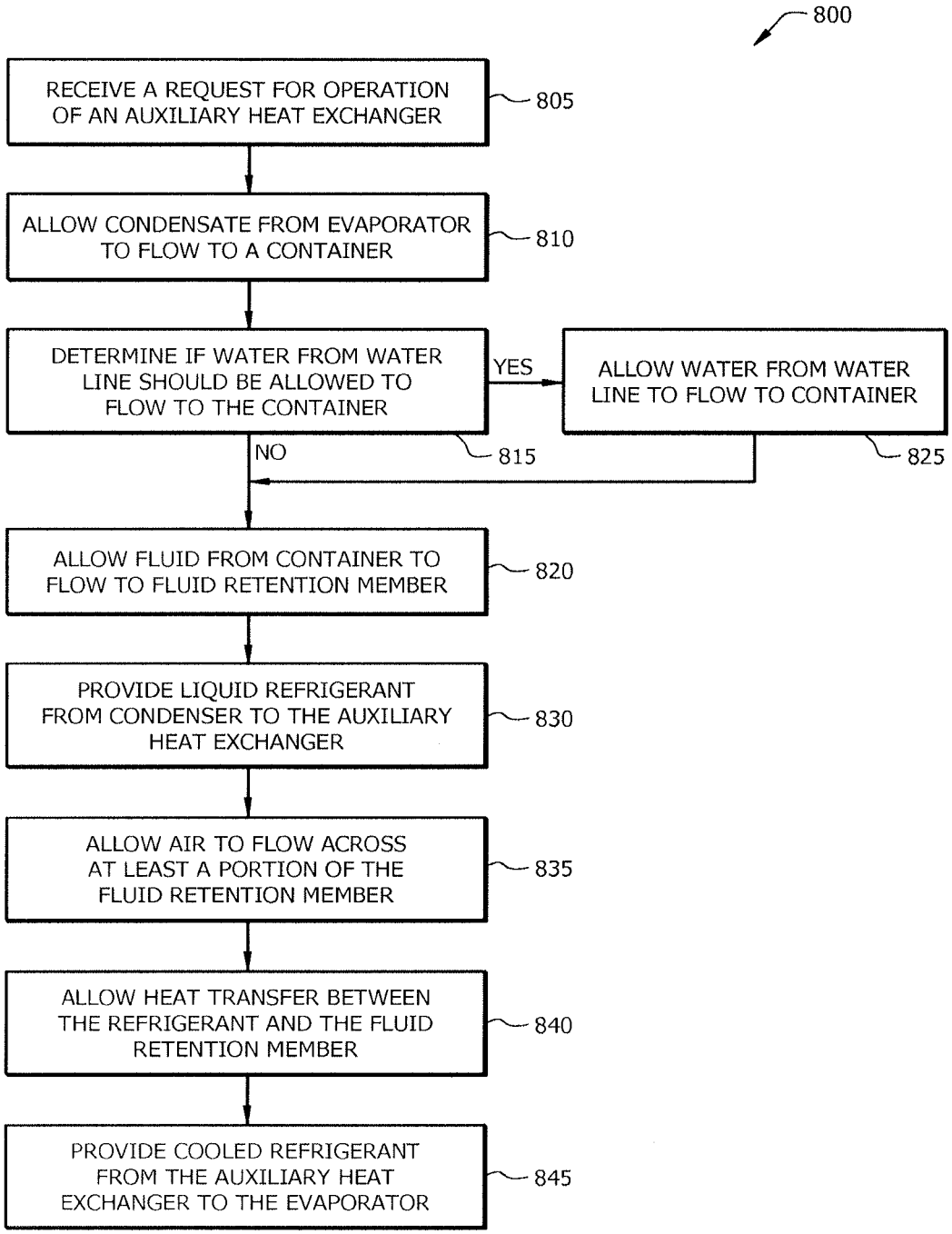
FIG. 8 illustrates an implementation of an example process for operation of an auxiliary heat exchanger.

FIG. 8 illustrates an example process 800 for operating an auxiliary heat exchanger that includes a fluid retention member. A request for the operation of the auxiliary heat exchanger may he received (operation 805). For example, a user may request operation of the auxiliary heat exchanger. The air conditioner may include default settings, such as allowing the auxiliary heat exchanger to operate unless other instructions are received and/or allowing the auxiliary heat exchanger to operate under predetermined circumstances (e.g., at predetermined temperatures, the auxiliary heat exchanger may operate or be restricted from operating).

At least a part of the condensate from the evaporator may be allowed to flow from the evaporator to the container (operation 810). For example, condensate from the evaporator may be collected and flow through a line to a container (e.g., a container containing condensate and/or water from other sources) and/or a sewer line.

A determination may be made whether water from the water line should be allowed to flow to the container (operation 815). For example, a tank level may be determined and the determination whether to open the water line valve to allow fluid flow into the container may be made based on the determined tank level. As another example, a tank level may be determined and if the tank level is greater than a predetermined maximum tank level, the condensate from the evaporator may be restricted from flowing into a container and flow into a sewer line. The use of a water line may be based at least partially on operating conditions. For example, in high humidity environments, the fluid from the evaporator may satisfy the fluid needs of the auxiliary heat exchanger and water from a water line may not be utilized. In less humid environments, the water line may be utilized to supplement the condensate collected.

If the determination is made that the water should not be allowed to flow into the container from the water line (e.g., the liquid level of fluid in the container is high), fluid from the container may be allowed to flow to the fluid retention member (operation 820). For example, a valve may restrict water flow from the water line. A pump and/or gravity may deliver the fluid from the container to the fluid retention member.

If the determination is made that water from the water line should be allowed to flow to the container, the water line may be allowed to flow to the container (operation 825) and fluid from the container may be allowed to flow to the fluid retention member (operation 820). For example, a valve may automatically open and/or close based on a level of the container and allow water from the water line to flow and/or be restricted from flowing into the container. In some implementations, a valve may not be positioned in the line from the evaporator and condensate may not be restricted from flowing into the container.

At least a part of the liquid refrigerant may be provided from the condenser to the auxiliary heat exchanger (operation 830). For example, liquid refrigerant may be allowed to flow through a conduit coupled to and/or proximate to a surface of the auxiliary heat exchanger (e.g., a second surface opposed to the first surface proximate the fluid retention member).

Air flow may be allowed to flow across at least a portion of the fluid retention member (operation 835). For example, an opening may be disposed in a housing of the auxiliary heat exchanger and air may flow at least partially through the opening and across at least a portion of the fluid retention member. The opening may be an opening in a tube (e.g., a tube with a round, oval, or other appropriately shaped cross-section) of the auxiliary heat exchanger. At least partially controlling the direction of the air flow (e.g., through the opening and/or design of the auxiliary heat exchanger) may allow control of the release of the air processed by the auxiliary heat exchanger. For example, controlling the air flow through the auxiliary heat exchanger may allow the air to return to approximately ambient temperature prior to release.

Heat transfer may be allowed between the refrigerant and the fluid retention member (operation 840). In some implementations, the fluid retention member and/or fluid (e.g., condensate and/or water from the water line) may be at a lower temperature than ambient temperature (e.g., a temperature proximate a condenser and/or auxiliary heat exchanger). The refrigerant may be at a higher temperature than ambient temperature. Heat may transfer from the higher temperature refrigerant to the fluid in the fluid retention member by the air flow across the fluid retention member (e.g., air flow through the opening in the auxiliary heat exchanger). Air flow across the fluid retention member may cool the fluid retention member (e.g., due to the evaporation of the fluid at least partially retained). Heat from the refrigerant may be transferred to the cooler fluid retention member and thus heat may be removed from the refrigerant, in some implementations.

At least a portion of the cooled refrigerant from the auxiliary heat exchanger may be provided to the evaporator (operation 845). For example, the air conditioner may include a thermal expansion valve that automatically regulates the amount of refrigerant allowed to enter the evaporator. The cooled refrigerant from the auxiliary heat exchanger may flow to the thermal expansion valve and then the evaporator.

Process 800 may be implemented by various systems, such as system 100, 200, 250, 400, 500, 700, and/or 900 (illustrated in FIG. 9). In addition, various operations may be added, deleted, or modified. For example, refrigerant from the auxiliary heat exchanger may flow directly to the evaporator. As another example, the air conditioner may be allowed to bypass the auxiliary heat exchanger and flow from the condenser to the thermal expansion valve and/or evaporator. In some implementations, a container may not be included. Condensate and/or water from the water line may be provided directly to the auxiliary heat exchanger. In some implementations, water from the water line may be allowed to flow into the container and flow from the evaporator may be restricted.

In some implementations, a thermoelectric cooler may be utilized to generate a cold zone proximate a surface of the auxiliary heat exchanger. FIG. 9 illustrates an implementation of a portion 900 of an air conditioner. As illustrated, an auxiliary heat exchanger 950 may be coupled to a power source 932 and a condenser 955. A fan 920 may provide air flow to the auxiliary heat exchanger 950 and/or the condenser 955. The power source 932 may be the same power source for the air conditioner and/or a different power source. The auxiliary heat exchanger may include a converter 925 coupled to the thermoelectric cooler 930. The converter 925 may convert, for example, alternating current from the power source 932 to a direct current for the thermoelectric cooler 930. The thermoelectric cooler 930 may be coupled to a housing 940, such as a plate, of the auxiliary heat exchanger 950. The thermoelectric cooler 930 may generate a temperature proximate a first surface 905 of the housing 940 of the auxiliary heat exchanger 950 that is lower than ambient temperature (e.g., temperature proximate the condenser 955 and/or auxiliary heat exchanger). The refrigerant in the refrigerant conduit 915 may be coupled to a second surface 910 of the housing 940 of the auxiliary heat exchanger 950 that is opposed to the first surface 905. The refrigerant in the refrigerant line 915 may be at a temperature higher than ambient temperature. Air may flow across a hot side of the thermoelectric cooler. The air may remove heat from the thermoelectric cooler and/or inhibit overheating. This may facilitate heat transfer between the thermoelectric cooler 930 and the refrigerant in the refrigerant conduit 915.

FIG. 1000 illustrates an implementation of an example process 1000 for operation of an auxiliary heat exchanger that includes a thermoelectric cooler. A request for operation of the auxiliary heat exchanger may be received (operation 1005). For example, an air conditioner may have a predetermined setting that allows operation of the auxiliary heat exchanger. The request for operation may include an initial installation design (e.g., a default setting) that directs refrigerant flow to the auxiliary heat exchanger.

A current from a power source may be provided (operation 1010). For example, the power source may be a 240V alternating current power source. The power source may be a battery. The power source may provide power to the thermoelectric cooler. A current from the power source may be converted (operation 1015). For example, an AC-DC converter may be utilized. The converted current may be provided to the thermoelectric cooler (operation 1020). For example, wires may couple the power source, converter, and/or thermoelectric cooler(s).

At least a part of the liquid refrigerant from the condenser may be provided to the auxiliary heat exchanger (operation 1025). For example, a line may couple the condenser and a portion of the auxiliary heat exchanger. Refrigerant may be allowed to flow through an inlet of the refrigerant line in the auxiliary heat exchanger and out of an outlet of the refrigerant line in the auxiliary heat exchanger.

Air may be allowed to flow across at least a portion of the thermoelectric cooler (operation 1030). For example, air may flow across at least a portion of a hot side of a thermoelectric cooler.

Heat transfer may be allowed between the refrigerant in the auxiliary heat exchanger and the thermoelectric cooler (operation 1035). The refrigerant may be at a higher temperature than the thermoelectric cooler and thus heat may be transferred to the thermoelectric cooler from the refrigerant in the refrigerant conduit. The refrigerant may exit the auxiliary heat exchanger at a temperature at or below approximately ambient temperature.

Cooled refrigerant maybe provided to the evaporator (operation 1040). For example, the refrigerant may flow to a thermal expansion valve and/or to the evaporator from the auxiliary heat exchanger. The cooled refrigerant may have a temperature of at least three degrees Fahrenheit above an ambient temperature (e.g., proximate the auxiliary heat exchanger and/or the temperature of the air disposed in the opening in the auxiliary heat exchanger). As another example, the cooled refrigerant may have a temperature below ambient temperature.

Process 1000 may be implemented by various systems, such as system 100, 200, 250, 400, 500, 700, and/or 900. In addition, various operations may be added, deleted, or modified. For example, an auxiliary heat exchanger may include a fluid retention member and a thermoelectric cooler and various operations of process 1000 and 900 may be performed. As another example, a converter may not be utilized. In some implementations, a determination may be made whether a request for operation of the auxiliary heat exchanger has been received. If the determination has been made that the request for operation of the auxiliary heat exchanger has not been received, the auxiliary heat exchanger may be bypassed. In some implementations, the refrigerant may flow though the auxiliary heat exchanger, but the auxiliary heat exchanger may be turned off (e.g., air flow from fan may be inhibited and/or the thermoelectric cooler may be turned off). When the auxiliary heat exchanger is turned off, the temperature of the refrigerant entering the auxiliary heater exchanger may not be substantially reduced.

In some implementations, the auxiliary heat exchanger and/or portions thereof may be a retrofit kit. The retrofit kit may allow existing air conditioners without auxiliary heat exchangers to be altered to include auxiliary heat exchangers. A user may couple the auxiliary heat exchanger to at least a portion of the air conditioner. A refrigerant line between a condenser and thermal expansion valve and/or evaporator may be altered such that the refrigerant flows through the auxiliary heat exchanger prior to flowing through the thermal expansion valve and/or evaporator.

In some implementations, the auxiliary heat exchanger may be provided in an air conditioner prior to operation and/or installation at a location. The air conditioner may restrict use of the air conditioner without the auxiliary heat exchanger operation, in some implementations.

In some implementations, various described system(s) and/or operation of the various described process(es) may increase an EER (energy efficiency ratio) rating and/or SEER (seasonal energy efficiency ratio) rating by at least approximately 0.5 point. The EER and/or SEER rating may be increased by from approximately 0.5 to approximately 1 point.

In various implementations, fluid, such as air from a condenser fan is described as being provided to various components of the air conditioner, such as the auxiliary heat exchanger. In some implementations, the auxiliary heat exchanger may include a fan separate from the condenser fan.

Although various lines (e.g., refrigerant line) have been described, a line may include any appropriate conduit for transporting fluids, such as tubes, pipes, and/or ducts. Although various fans have been described, any appropriate fan may be utilized, such as axial, centrifugal, etc.

Although a specific implementation of the system is described above, various components may be added, deleted, and/or modified. In addition, the fluids are described for exemplary purposes. Fluids may vary, as appropriate. For example, a refrigerant may include any appropriate heat transfer fluid. Although air has been described as provided by various fans to component(s), any appropriate fluid may be utilized. Although water has been described as being provided to a fluid retention member, container, and/or distributer, any appropriate fluid may be utilized. For example, water from the condensate and/or sewer line may include various impurities. A fluid may be a gas and/or a liquid. For example, although the refrigerant has been described as gaseous and/or liquid, the refrigerant may include gas and/or liquid in various portions of the air conditioner and/or auxiliary heat exchanger.

Although a cooling cycle has been described, the air conditioner may be operable when flow is reversed (e.g., a reversible valve may be included to reverse the flow of refrigerant in the system), in some implementations, to provide a heating cycle. In some implementations, one or more of the various described systems may be utilized and/or processes may be performed in conjunction with a system that allows cooling and/or heating, as appropriate.

Although fans have been described, any appropriate blower may be utilized (e.g., centrifugal fan, cross-flow fan, and/or axial fan). A controller may include any appropriate computing device such as a server and/or any other appropriate programmable logic device.

Although processes 600, 800, and 1000 have been described separately, various operations from processes 600, 800, and 1000 may be combined, deleted, and/or modified. For example, one or more of the operations in process 600 and one or more of the operations from process 800 may be combined. As another example, one or more of the operations from process 800 and one or more of the operations from process 1000 may be combined.

The systems and methods discussed above allow for cooling refrigerant in two stages using condenser 120 and auxiliary heat exchanger 130. Additional examples of two-stage cooling are further described with respect to FIGS. 11-14 below.

Figure 11:
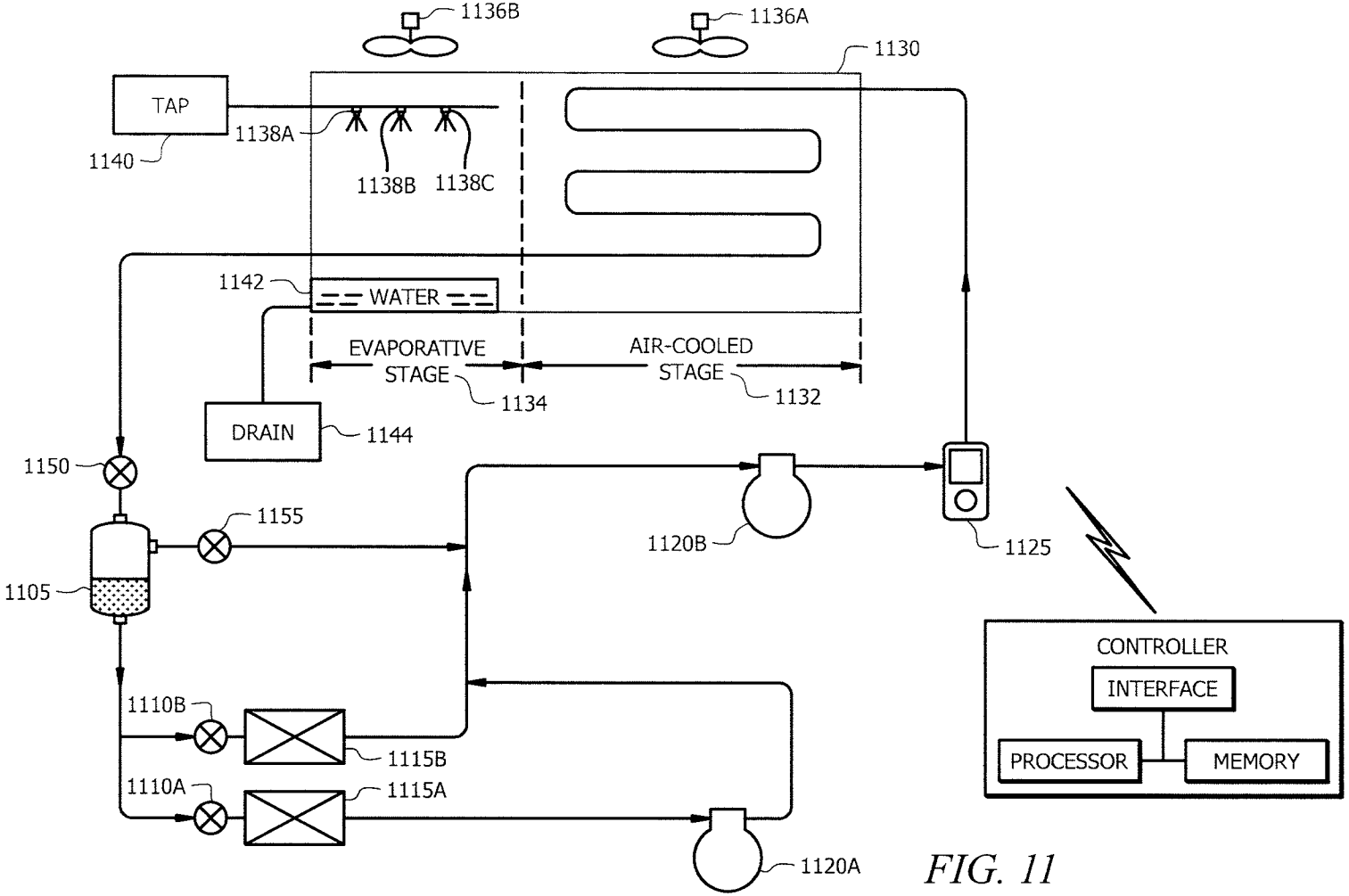
FIG. 11 illustrates an implementation of an example refrigeration system comprising a multi-stage cooler.

FIG. 11 illustrates an implementation of an example refrigeration system comprising a multi-stage cooler. The refrigeration system comprises a flash tank 1105, one or more evaporator valves 1110 corresponding to one or more evaporators 1115, one or more compressors 1120, an oil separator 1125, a gas cooler 1130, an expansion valve 1150, and a flash gas bypass valve 1155. As depicted in FIG. 11, the refrigeration system includes two evaporator valves (1110A and 1110B) corresponding to two evaporators (1115A and 1115B), and two compressors (1120A and 1120B). Each component may be installed in any suitable location, such as a mechanical room (e.g., the flash tank 1105 and compressors 1120 may be in a mechanical room), in a consumer-accessible location (e.g., evaporators 1115 may be located on a sales floor), or outdoors (e.g., gas cooler 1130 may be located on a rooftop).

In general, flash tank 1105 supplies liquid refrigerant to first evaporator 1115A and second evaporator 1115B via evaporator valves 1110A and 1110B, respectively. Evaporator valves 1110A and 1110B may comprise expansion valves. Valves 1110A and 1110B may receive the liquid refrigerant from the flash tank 1105 at the same temperature and pressure, and each valve 1110 may be controlled (e.g., by a controller) to adjust the pressure of the liquid refrigerant in order to control the temperature of the refrigerant supplied to its respective evaporator 1115.

In certain embodiments, first evaporator 1115A is operable to evaporate the refrigerant in order to cool a first case (or set of cases). As an example, the first case may be a low-temperature ("LT") case, such as a grocery store display case used to store frozen food. In certain embodiments, second evaporator 1115B is operable to evaporate the refrigerant in order to cool a second case (or set of cases). As an example, the second case may be a medium-temperature ("MT") case, such as a grocery store display case used to store fresh food. Thus, the second case (MT case) has a higher temperature set point than the first case (LT case). As an example, the MT case may be set to −6° C. and the LT case may be set to −30° C.

In some embodiments, first evaporator 1115A may be configured to discharge warm refrigerant vapor to first compressor 1120A (also referred to herein as an LT compressor 1120A). First compressor 1120A provides a first stage of compression to the warmed refrigerant from the first evaporator 1115A and discharges the compressed refrigerant to second compressor 1120B for further compression. Second evaporator 1115B also discharges warm refrigerant vapor to second compressor 1120B (also referred to herein as an MT compressor 1120B).

Second compressor 1120B discharges compressed refrigerant to gas cooler 1130 for cooling. In some embodiments, refrigeration system may include an oil separator 1125 that separates compressor oil from the refrigerant prior to flowing the refrigerant to gas cooler 1130. Gas cooler may include multiple stages, such as an air-cooled stage 1132 and an evaporative stage 1134. The air-cooled stage 1132 is operable to apply a first cooling stage to the refrigerant discharged from the second compressor 1120B. The evaporative stage 1134 is operable to apply a second cooling stage to the refrigerant discharged from the air-cooled stage 1132. The air-cooled stage 1132 and evaporative stage 1134 may be arranged in any suitable manner. For example, the air-cooled stage 1132 and evaporative stage 1134 can be contained within the same housing. Alternatively, the air-cooled stage 1132 and the evaporative stage 1134 could be contained in separate housings, in which case the outlet of the air-cooled stage 1132 may connect to the inlet of the evaporative stage 1134 through any suitable conduit.

The air-cooled stage 1132 may comprise one or more fans (e.g., fan 1136A) operable to circulate ambient air over a conduit that circulates the refrigerant through the air-cooled stage. As an example, in certain embodiments, the air-cooled stage 1132 may be an air-cooled condenser (e.g., if the ambient temperature is low, the refrigerant pressure could be lower than the critical point) or an air-cooled gas cooler (e.g., if the ambient temperature is high, the refrigerant pressure could be higher than the critical point). The condenser utilizes fans and vents to pull in surrounding air and circulate the air around condenser coils that have been heated by the warm refrigerant received from compressor 1120B. The heat from the refrigerant is transferred to the circulating air, and the hot air is vented away from the refrigerant.

Because the air-cooled stage uses ambient air to cool the refrigerant, it is able to cool the refrigerant to a temperature near the dry bulb ambient temperature. For example, in certain embodiments, the temperature of the refrigerant may decrease to a value, for example, 5° F. above dry bulb ambient temperature. If the surrounding air is warm or hot, the fans and vents of the air-cooled condenser will suck the warm air into the unit and try to cool off the condenser with that warm air. Thus, particularly in warm or hot environments, the refrigerant discharged from the air-cooled stage 1132 may still be relatively warm. The refrigerant may proceed to the evaporative cooling stage 1134 to further cool the refrigerant to a temperature at which the refrigeration system may run more efficiently.

The evaporative stage 1134 comprises one or more nozzles (e.g., 1138A-C) operable to dispense water over a conduit that circulates the refrigerant through the evaporative stage. The evaporative stage 1134 may also comprise one or more fans (e.g., 1136B) that may direct the water (and ambient air) toward the conduit in order to facilitate the evaporative cooling. In certain embodiments, the water is supplied to nozzles 1138 from a tap 1140. Condensate from the evaporator and/or water that passes over the conduit without evaporating can be collected in a reservoir 1142 and discharged through a drain 1144 (for example, to a sewer). In certain embodiments, the evaporative stage 1134 of gas cooler 1130 decreases the temperature of the refrigerant further, for example, to 5° F. below the dry bulb ambient temperature.

Gas cooler 1130 may further comprise an outlet operable to discharge the cooled refrigerant to an expansion valve 1150 that supplies refrigerant to the flash tank 1105 from which first evaporator 1115A and the second evaporator 1115B receive refrigerant. Expansion valve 1150 may be configured to reduce the pressure of refrigerant and reduce flash gas flow rate to the flash tank 1105. In some embodiments, this reduction in pressure causes some of the refrigerant to vaporize. As a result, mixed-state refrigerant (e.g., refrigerant vapor and liquid refrigerant) is discharged from expansion valve 1150 to flash tank 1105. Flash tank 1105 may be configured to receive mixed-state refrigerant and separate the received refrigerant into flash gas and liquid refrigerant. The liquid refrigerant flows from flash tank 1105 to evaporators 1115, and the flash gas flows through flash gas bypass valve 1155 to one or more compressors (e.g., MT compressor 1220B) for compression.

In some embodiments, refrigeration system 100 may be configured to circulate natural refrigerants such as carbon dioxide (CO2), water, air, and hydrocarbon (HC) (e.g., propane (C3H8) or isobutane (C4H10)). Natural refrigerants may be associated with various environmentally conscious benefits (e.g., they do not contribute to ozone depletion and/or global warming effects). As an example, certain embodiments can be implemented in a transcritical refrigeration system (i.e., a refrigeration system in which the heat rejection process occurs above the critical point). In a transcritical refrigeration system, first compressor 1120A can comprise a subcritical compressor and second compressor 1120B can comprise a transcritical compressor. Other embodiments may use different types of refrigerant, such as hydrofluorocarbon (HFC).

Figure 12:
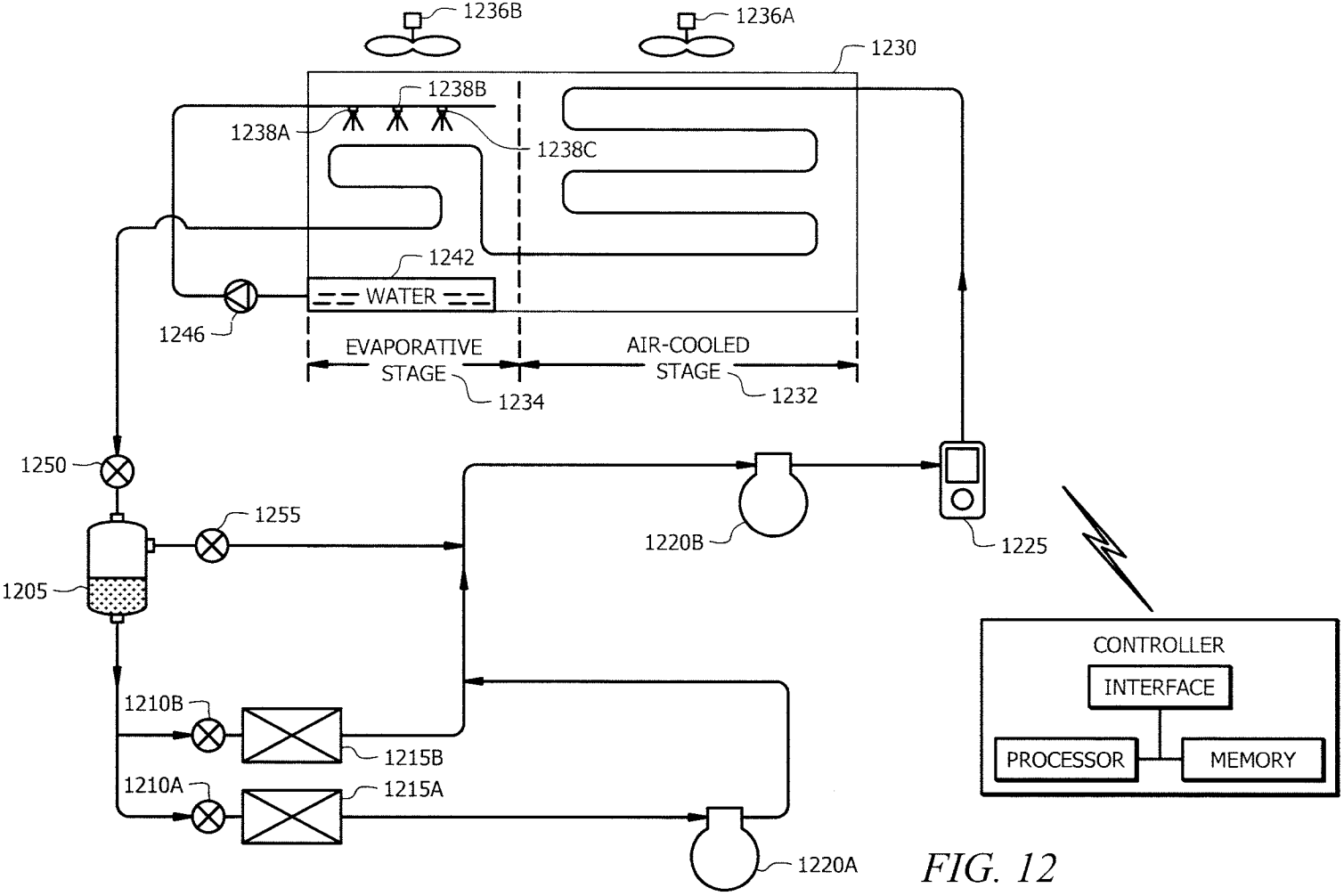
FIG. 12 illustrates an implementation of an example refrigeration system comprising a multi-stage cooler.

FIG. 12 illustrates an implementation of an example refrigeration system comprising a multi-stage cooler. The refrigeration system depicted in FIG. 12 is generally similar to the refrigeration system discussed above with respect to FIG. 11. For example, the refrigeration system depicted in FIG. 12 includes a flash tank 1205 (similar to flash tank 1105 of FIG. 11), evaporator valves 1210 (similar to evaporator valves 1110 of FIG. 11), evaporators 1215 (similar to evaporators 1115 of FIG. 11), compressors 1220 (similar to compressors 1120 of FIG. 11), oil separator 1225 (similar to oil separator 1125 of FIG. 11), gas cooler 1230 (discussed below), expansion valve 1250 (similar to expansion valve 1150 of FIG. 11) and flash gas bypass valve 1255 (similar to flash gas bypass valve 1155 of FIG. 11).

Gas cooler 1230 includes an air-cooled stage 1232 similar to the air-cooled stage 1132 of FIG. 11. For example, the air-cooled stage 1232 may comprise one or more fans (e.g., fan 1236A) operable to cool the refrigerant by circulating ambient air over a conduit that flows the refrigerant through the air-cooled stage.

Gas cooler 1230 also includes an evaporative stage 1234. The evaporative stage 1234 comprises one or more nozzles (e.g., 1238A-C) operable to dispense water over a conduit that circulates the refrigerant through the evaporative stage. The evaporative stage 1234 may also comprise one or more fans (e.g., 1236B) that may direct the water (and ambient air) toward the conduit in order to facilitate the evaporative cooling. In certain embodiments, the water is supplied to nozzles 1238 from a pump 1246. Condensate from the evaporator and/or water that passes over the conduit without evaporating can be collected in a reservoir 1142 and recirculated to nozzles 1238 via pump 1246. In certain embodiments, the evaporative stage 1134 of gas cooler 1130 decreases the temperature of the refrigerant further, for example, to 5° F. below the dry bulb ambient temperature.

This disclosure recognizes that a refrigeration system, such as that depicted in FIG. 11 and FIG. 12, may comprise one or more other components. As an example, the refrigeration system may comprise one or more parallel compressors, ejectors, sensors, desuperheaters, and/or other components in some embodiments. As another example, the refrigeration system may comprise a controller operable to control the operation of the system. The controller may include any suitable interface (e.g., wired or wireless interfaces), processing circuitry (e.g., one or more computers, one or more central processing units (CPUs), one or more microprocessors, one or more applications, one or more application specific integrated circuits (ASICs), one or more field programmable gate arrays (FPGAs), and/or other logic), memory (e.g., Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium), etc. for performing the described functionality. One of ordinary skill in the art will appreciate that the refrigeration system may include other components not mentioned herein.

A two-stage gas cooler similar to the one depicted in FIGS. 11-12 could be used in various environments, such as a $CO_2$ transcritical refrigeration system for a supermarket (or for an industrial application) in a hot and dry climate, an HFC refrigeration system for a supermarket (or for an industrial application) in a hot and dry climate, an air conditioning system with direct condenser cooling in a hot and dry climate, or other suitable environment.

Figure 13:
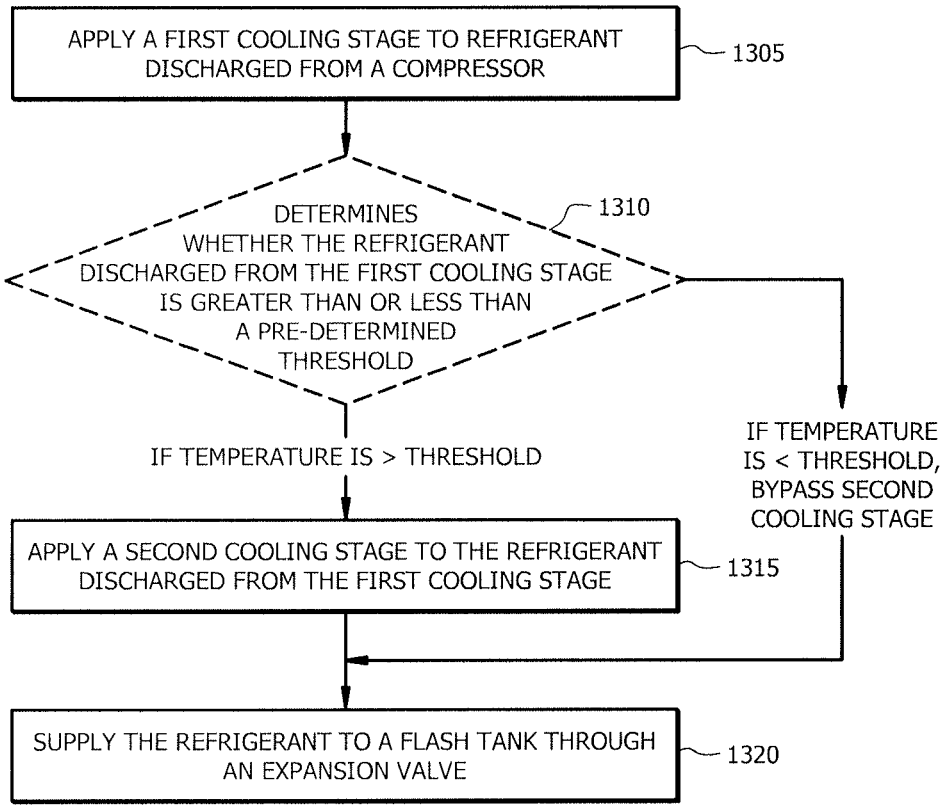
FIG. 13 illustrates an example of a method cooling a refrigerant using a multi-stage system.

FIG. 13 illustrates an example of a method cooling a refrigerant using a multi-stage system. At step 1305, the method applies a first cooling stage to refrigerant discharged from a compressor. The refrigerant may comprise carbon dioxide ($CO_2$), hydrofluorocarbon (HFC), or other suitable refrigerant. The first cooling stage comprises air-cooling, such as described with respect to the air-cooled stage 1132 and 1232 above. In certain embodiments, the air-cooled stage decreases the temperature of the refrigerant to a value, for example, 5° F. above dry bulb ambient temperature.

Certain embodiments of the method may optionally include step 1310. At step 1310, the method determines whether the refrigerant discharged from the first cooling stage is greater than or less than a pre-determined threshold. In response to determining that the refrigerant discharged from the first cooling stage is greater than the pre-determined threshold, the method may proceed to step 1315. At step 1315, the method applies a second cooling stage to the refrigerant discharged from the first cooling stage. The second cooling stage comprises evaporative cooling, such as described with respect to the evaporative stage 1134 and 1234 discussed above. The evaporative stage may comprise cooling the refrigerant through the evaporation of water dispensed via one or more nozzles. The water may be supplied to the nozzles from a tap (e.g., FIG. 11) or from a pump that pumps water from a reservoir that collects condensate or run-off from the nozzles (e.g., FIG. 12). In certain embodiments, the evaporative stage decreases the temperature of the refrigerant to, for example, 5° F. below the dry bulb ambient temperature.

At step 1320, the method supplies the cooled refrigerant to expansion valve (e.g., 1150 or 1250) with less vapor at outlet. The flash tank (e.g., 1105 or 1205) may receive the refrigerant from the gas cooler outlet via the expansion valve and may flow the refrigerant to the evaporator (e.g., 1115) via an evaporator valve (e.g., 1110). The evaporator is operable to cool a space. As an example, the evaporator may be a component of an air conditioner operable to cool a building. As another example, the evaporator may be a component of a refrigeration system operable to cool a refrigerated case or a freezer.

Referring back to step 1310, if it had been determined that the refrigerant discharged from the first cooling stage is less than the pre-determined threshold, the method may be further operable to bypass the second cooling stage (skip step 1315) and proceed directly to step 1320. As an example, at cool ambient temperatures, the air-cooled stage may provide adequate efficiency on its own such that it may make sense to bypass the evaporative stage in order to conserve water. In some embodiments, the threshold may be determined at least in part based on whether the system is located in a dry climate. If the refrigerant discharged from the first cooling stage subsequently increases above the threshold, the method may resume use of the second cooling stage.

In certain embodiments, the determination whether to use or bypass the second cooling stage may be performed by a controller operable to determine the temperature of refrigerant discharged from the first cooling stage (e.g., based on information from a sensor that measures the air-cooler outlet temperature or the dry bulb ambient temperature), compare the temperature to the pre-determined threshold (e.g., the threshold may be determined based on a parameter setting or based on applying a rule to information obtained from one or more sensors), and turn the second stage cooling on or off depending on whether the temperature is greater than or less than the threshold.

Modifications, additions, or omissions may be made to the method of FIG. 13 without departing from the scope of the disclosure. The method may include more, fewer, or other steps. Additionally, steps may be performed in any suitable order.

Figure 14:
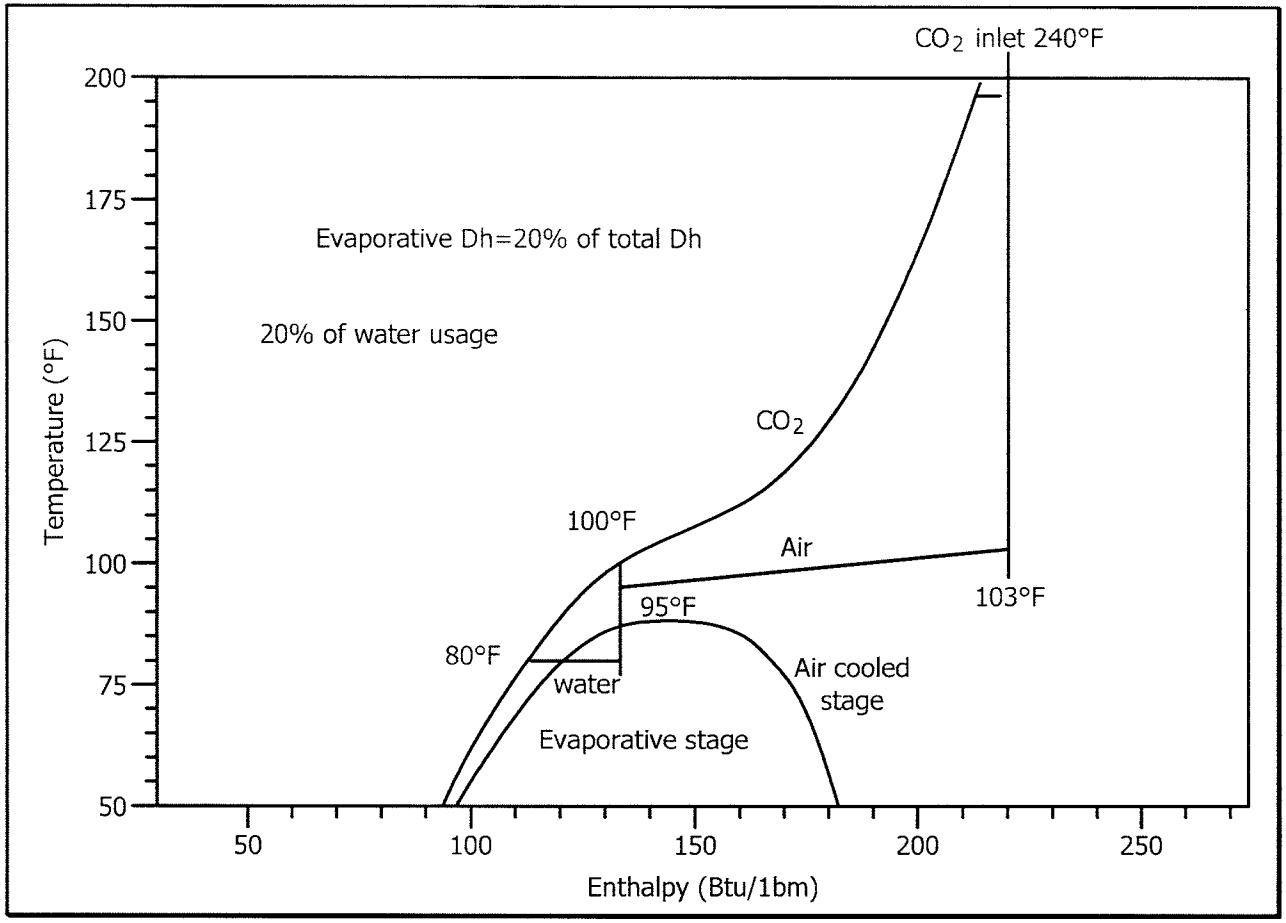
FIG. 14 illustrates an example of enthalpy of a refrigeration system that uses multi-stage cooling.

A multi-stage gas cooler, such as gas cooler 1130 or 1230 of FIG. 11 or 12, may allow for more energy efficient cooling compared to refrigeration systems that only use air-cooling and may allow for more water-efficient cooling compared to refrigeration systems that only use evaporative cooling. In certain embodiments, the multi-stage gas cooler can save 50-80% of water compared to an evaporative type gas cooler. In certain embodiments, the multi-stage gas cooler can improve system efficiency 10-20% at the design condition compared to existing air cooled systems. An example of the efficiencies that can be realized using the multi-stage gas cooler is provided in FIG. 14. FIG. 14 provides a graph depicting enthalpy (Btu/lpm) along the x-axis and temperature (° F.) along the y-axis. In the example, CO2 refrigerant is cooled to approximately 95° F. during the air cooled stage and is further cooled to approximately 80° F. during the evaporative stage.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a surface" includes a combination of two or more surfaces and reference to "a fluid" includes different types and/or combinations of fluids. As another example, "water" may include components other than water and/or in addition to water. Coupling may include direct and/or indirect coupling. Although a system with one auxiliary heat exchanger and/or one type of auxiliary heat exchanger has been described, a system may include more than one auxiliary heat exchanger and/or type of heat exchanger.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A refrigeration system, comprising:

a first evaporator operable to receive refrigerant in liquid form from a flash tank and to evaporate the refrigerant in order to cool a first case;

a second evaporator operable to receive the refrigerant in liquid form from the flash tank and to evaporate the refrigerant in order to cool a second case, the second case having a higher temperature set point than the first case;

a first compressor operable to compress the refrigerant discharged from the first evaporator;

a second compressor operable to compress the refrigerant discharged from the first compressor and the refrigerant discharged from the second evaporator; and a gas cooler, the gas cooler comprising:

an air-cooled stage operable to apply a first cooling stage to the refrigerant discharged from the second compressor;

an evaporative stage operable to apply a second cooling stage to the refrigerant discharged from the air-cooled stage; and an outlet operable to supply the cooled refrigerant to the flash tank.

2. The refrigeration system of claim 1, wherein the refrigerant comprises carbon dioxide ($CO_2$), the first compressor comprises a subcritical compressor, and the second compressor comprises a transcritical compressor.

3. The refrigeration system of claim 1, wherein the air-cooled stage decreases the temperature of the refrigerant to a value no more than 5° F. above dry bulb ambient temperature and the evaporative stage decreases the temperature of the refrigerant at least 5° F. below the dry bulb ambient temperature.

4. The refrigeration system of claim 1, wherein the air-cooled stage comprises a fan operable to circulate ambient air over a conduit that circulates the refrigerant through the air-cooled stage.

5. The refrigeration system of claim 1, wherein the evaporative stage comprises a nozzle operable to dispense water over a conduit that circulates the refrigerant through the evaporative stage, wherein the water is supplied form a tap.

6. The refrigeration system of claim 1, wherein the evaporative stage comprises:

a nozzle operable to dispense water over a conduit that circulates the refrigerant through the evaporative stage;

a reservoir operable to collect water dispensed from the nozzle; and a pump operable to pump water from the reservoir to the nozzle.

7. A gas cooler, comprising:

an air-cooled stage operable to apply a first cooling stage to refrigerant discharged from a compressor;

an evaporative stage operable to apply a second cooling stage to the refrigerant discharged from the air-cooled stage; and an outlet operable to supply the cooled refrigerant to a flash tank through an expansion valve.

8. The gas cooler of claim 7, wherein the refrigerant comprises carbon dioxide (CO2).

9. The gas cooler of claim 7, wherein the air-cooled stage decreases the temperature of the refrigerant to a value no more than 5° F. above dry bulb ambient temperature and the evaporative stage decreases the temperature of the refrigerant at least 5° F. below the dry bulb ambient temperature.

10. The gas cooler of claim 7, wherein the air-cooled stage comprises a fan operable to circulate ambient air over a conduit that circulates the refrigerant.

11. The gas cooler of claim 7, wherein the evaporative stage comprises a nozzle operable to dispense water over a conduit that circulates the refrigerant, wherein the water is supplied form a tap.

12. The gas cooler of claim 7, wherein the evaporative stage comprises:

a nozzle operable to dispense water over a conduit that circulates the refrigerant;

a reservoir operable to collect water dispensed from the nozzle; and a pump operable to pump water from the reservoir to the nozzle.

13. A method, comprising:

applying a first cooling stage to refrigerant discharged from a compressor, the first cooling stage comprising an air-cooled stage;

applying a second cooling stage to the refrigerant discharged from the first cooling stage, the second cooling stage comprising an evaporative stage; and supplying the cooled refrigerant to an evaporator operable to cool a space.

14. The method of claim 13, wherein the refrigerant comprises carbon dioxide ($CO_2$) or hydrofluorocarbon (HFC).

15. The method of claim 13, wherein the air-cooled stage decreases the temperature of the refrigerant to a value no more than 5° F. above dry bulb ambient temperature and the evaporative stage decreases the temperature of the refrigerant at least 5° F. below the dry bulb ambient temperature.

16. The method of claim 13, wherein applying the evaporative stage comprises cooling the refrigerant through the evaporation of water supplied from a tap.

17. The method of claim 13, wherein applying the evaporative stage comprises cooling the refrigerant through the evaporation of water dispensed via one or more nozzles, collecting at least a portion of the dispensed water in a reservoir, and pumping the water from the reservoir to the one or more nozzles.

18. The method of claim 13, wherein the evaporator is a component of an air conditioner operable to cool a building.

19. The method of claim 13, wherein the evaporator is a component of a refrigeration system operable to cool a refrigerated case or a freezer.

20. The method of claim 13, further operable to bypass the second cooling stage if the temperature of the refrigerant discharged from the first cooling stage is less than a predetermined threshold.

* * * * *